US006761137B2

(12) United States Patent
Kurtzer et al.

(10) Patent No.: US 6,761,137 B2
(45) Date of Patent: Jul. 13, 2004

(54) RECIPROCATING PISTON INTERNAL COMBUSTION ENGINE

(75) Inventors: Gernot Kurtzer, Kirchheim unter Teck (DE); Erhard Rau, Weilheim (DE); Hubert Schnüpke, Stuttgart (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/373,892

(22) Filed: Feb. 25, 2003

(65) Prior Publication Data

US 2003/0159664 A1 Aug. 28, 2003

(30) Foreign Application Priority Data

Feb. 27, 2002 (DE) ..... 102 08 510

(51) Int. Cl.[7] ..... F02B 75/04
(52) U.S. Cl. ..... 123/48 B; 123/78 E
(58) Field of Search ..... 123/48 B, 78 E, 123/78 F

(56) References Cited

U.S. PATENT DOCUMENTS

| | | | |
|---|---|---|---|
| 1,901,263 | A | 3/1933 | Ruud |
| 2,062,209 | A | 11/1936 | Cook |
| 2,909,164 | A | 10/1959 | Biermann |
| 4,270,495 | A | 6/1981 | Freudenstein et al. |

FOREIGN PATENT DOCUMENTS

| | | |
|---|---|---|
| DE | 1 800 780 | 7/1970 |
| DE | 43 12 954 | 10/1994 |
| DE | WO 95/18296 | 7/1995 |
| FR | 607 215 | 11/1930 |
| GB | 353 986 | 8/1931 |
| GB | 2 249 131 | 4/1992 |
| JP | 09 228858 | 1/1998 |
| JP | 10 288046 | 10/1998 |

*Primary Examiner*—Noah P. Kamen
(74) *Attorney, Agent, or Firm*—Klaus J. Bach

(57) ABSTRACT

In a reciprocating internal combustion engine having first and second cylinder banks arranged adjacent each other so that the axes of their cylinders extend essential parallel, a crankshaft is rotatably supported at an end of the cylinder banks between the longitudinal axes of the cylinders of the first and second cylinder banks and includes crank pins, on which cross-levers are rotatably supported and piston rods connected with an end to the pistons are rotatably supported with their other ends on the cross levers which have sidewardly extending portions controllably supported by control arms for adjusting the compression ratio in the cylinders of the engine.

11 Claims, 3 Drawing Sheets

RECIPROCATING PISTON INTERNAL COMBUSTION ENGINE

BACKGROUND OF THE INVENTION

The invention relates to a reciprocating piston internal combustion engine having two adjacent cylinder banks with pistons movably disposed in the cylinders and having connecting rods for transmitting the movement of the pistons to a crankshaft.

The publication DE 43 12 954 A1 discloses such a reciprocating piston internal combustion engine, which is equipped with a device for variable compression of the mixture in the combustion chamber. The variable compression device comprises an upper connecting rod pivotally connected to the piston and to a lower cross lever, which is pivotally connected to a crankshaft. The connecting rod and the lower cross lever are connected to one another by a joint. A control lever, the position of which is variably adjustable, acts on a further joint on the cross lever. An adjustment of the position of the control lever also adjusts the point of articulation between the cross lever and the connecting rod. Different kinematic ratios with various top and bottom dead centers of the piston in the cylinder of the internal combustion engine can thereby be set, without the need to modify the design dimensions of the piston, the connecting rod or a crank pin on the crankshaft.

In order to vary the compression ratio, the casing-side point of articulation of the control lever must be at least capable of translatory displacement in the casing and the control lever must moreover be pivotally supported on the casing. In order to be able to displace the control lever, for adjustment of the compression ratio an additional mechanism is required.

It is the object of the invention to provide a compact reciprocating piston internal combustion engine having two banks of cylinders with adjustable compression ratios.

SUMMARY OF THE INVENTION

In a reciprocating internal combustion engine having first and second cylinder banks arranged adjacent each other so that the axes of their cylinders extend essential parallel, a crankshaft is rotatably supported between the longitudinal axes of the cylinders of the first and second cylinder banks and includes crank pins, on which cross levers are rotatably supported and piston rods connected with one of their ends to the pistons are rotatably supported with their other ends on the cross levers which have sidewardly extending portions that are controllably supported by control levers for adjusting the compression ratio in the cylinders of the engine.

The reciprocating piston internal combustion engine according to the invention combines the advantages of an internal combustion engine having two parallel banks of cylinders with the advantages of variable compression. The two banks of cylinders of the reciprocating piston internal combustion engine are arranged in relation to one another in such a way that the longitudinal axes of the cylinders in the first cylinder bank and second cylinder bank extend parallel or they enclose only a small angle, which is in particular less than 10°. The enclosed angle may be 5°, for example. With this at least approximately parallel arrangement of the two cylinder banks, a compact internal combustion engine of small overall dimensions is achieved, wherein the transverse dimensions, in particular, are less than those of a V-type internal combustion engines. The mechanism for the adjustment of the compression ratio comprises a cross-lever as a force transmitting member between the connecting rod and the crankshaft. This member is arranged transversely in relation to the longitudinal axis of the crankshaft. As a result, despite the approximately parallel alignment of the cylinders in the first and second cylinder bank, the connecting rods of each piston have are displaced by an adjustment of the transmission ratio only over a relatively small distance relative to the longitudinal cylinder axis for any adjustment position of the device for the adjustment of the transmission ratio. The lateral offset between cylinder longitudinal axis and crankshaft is bridged by means of the cross-lever.

It is furthermore proposed that the crankshaft is arranged in relation to the two cylinder banks in such a way that the longitudinal axis of the crankshaft lies between the longitudinal axes of the cylinders of the first and second cylinder bank. In particular, the crankshaft lies symmetrically or slightly asymmetrically below the first and second cylinder banks. In this arrangement the crankshaft is acted upon equally by the forces of the pistons of both cylinder banks, the power being transmitted between the connecting rods and the crankshaft via the cross levers.

Expediently, a cross lever is assigned to each piston of the internal combustion engine. In addition each cross lever is preferably connected to its own adjustable control lever. For this purpose the control lever is preferably pivotally connected to the cross lever on the side remote from the connecting rod. In this way each connecting rod can be supported essentially rectilinearly along the cylinder longitudinal axis and the reciprocating movement of the piston is performed symmetrically about the longitudinal axis of the cylinder, thereby avoiding a collision between the connecting rod and the cylinder inner walls. In addition this arrangement reduces the forces acting on the connecting rods and the pistons.

Immediately adjacent cylinders of the first and second cylinder banks may be slightly offset in the direction of the crankshaft longitudinal axis in order to avoid a collision between the cross levers assigned to the cylinders. This also makes it possible to provide two different crank pins on the crankshaft with different throw radii to the longitudinal axis of the crankshaft with or without intermediate webs, on which the cross levers of the immediately adjacent cylinders of the first and second cylinder banks are supported. The different throw radii mean that the kinematic lever ratios in the kinematic transmission path between connecting rod, cross lever and control lever between adjacent cylinders can be precisely adjusted to one another, particularly in the event that the control levers for the two cross levers of adjacent cylinders are situated on the same side of the internal combustion engine. This design affords the further advantage that all control levers can be adjusted by a common actuating member, for example by an eccenter shaft, which extends parallel to the crankshaft.

It may, however, also be expedient to couple the cross levers of adjacent cylinders with control levers disposed at opposite sides of the cylinder banks, an actuating member, in particular an eccentric shaft, being provided for each cylinder bank.

Other possible ways of adjusting the control levers may be considered as an alternative to an eccentric shaft. The control levers may also be actuated individually for example electrically, pneumatically or hydraulically. The use of template operating mechanisms is also possible.

Other advantages and suitable embodiments are set forth in the claims, the description of the drawings and the drawings.

DESCRIPTION OF PREFERRED EMBODIMENTS

Figure 1:
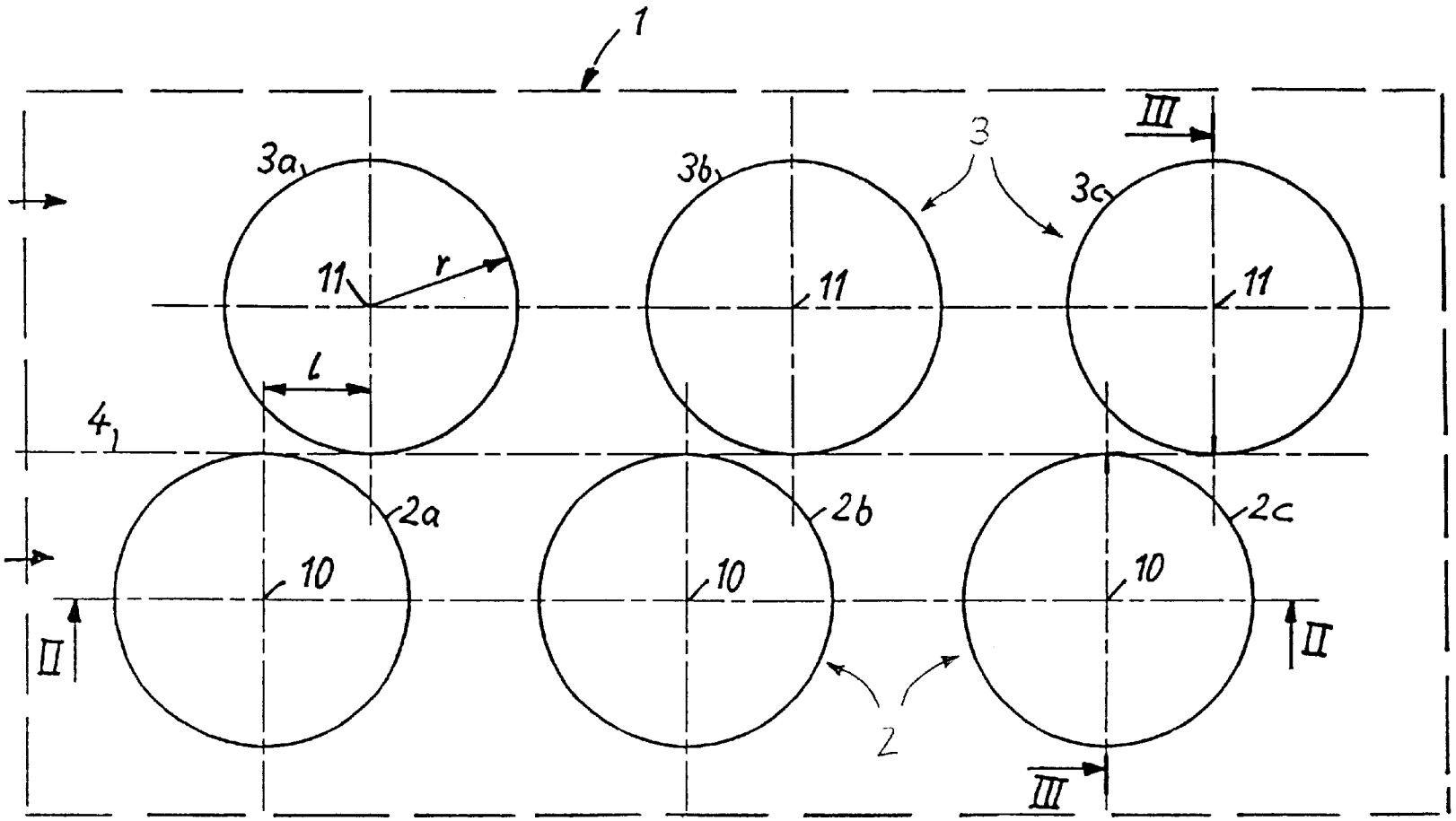
FIG. 1 is a plan view of a reciprocating piston internal combustion engine having first and second adjacent cylinder banks, the cylinders of the first cylinder bank and the second cylinder bank being offset in relation to one another in a longitudinal direction of the engine.

In the following figures identical parts are provided with the same reference numerals.

The reciprocating piston internal combustion engine 1 shown in FIG. 1 has two cylinder banks 2 and 3, which are arranged parallel to one another. The cylinders 2*a*, 2*b*, 2*c* of the first cylinder bank 2 are aligned parallel to the cylinders 3*a*, 3*b*, 3*c* of the second cylinder bank 3, so that the cylinder axes of all cylinders of the internal combustion engine 1 extend parallel. The two cylinder banks 2 and 3 are at opposite sides of a parting plane 4, which extends in the longitudinal direction of the internal combustion engine. The engine block including both cylinder banks 2, 3 is expediently manufactured as a one-piece component.

The cylinders 2*a*, 2*b*, 2*c* of the first cylinder bank 2 are arranged offset in relation to the cylinders 3*a*, 3*b*, 3*c* of the second cylinder bank 3 in the longitudinal direction of the internal combustion engine. This results in an offset length 1 between adjacent cylinders of the two cylinder banks, as measured between the longitudinal axes 10 and 11 of the cylinders. The offset length l, which may be less than the radius r of each cylinder, is relatively small because of a construction without intermediate webs between the crank pins for adjacent cylinders.

Figure 2:
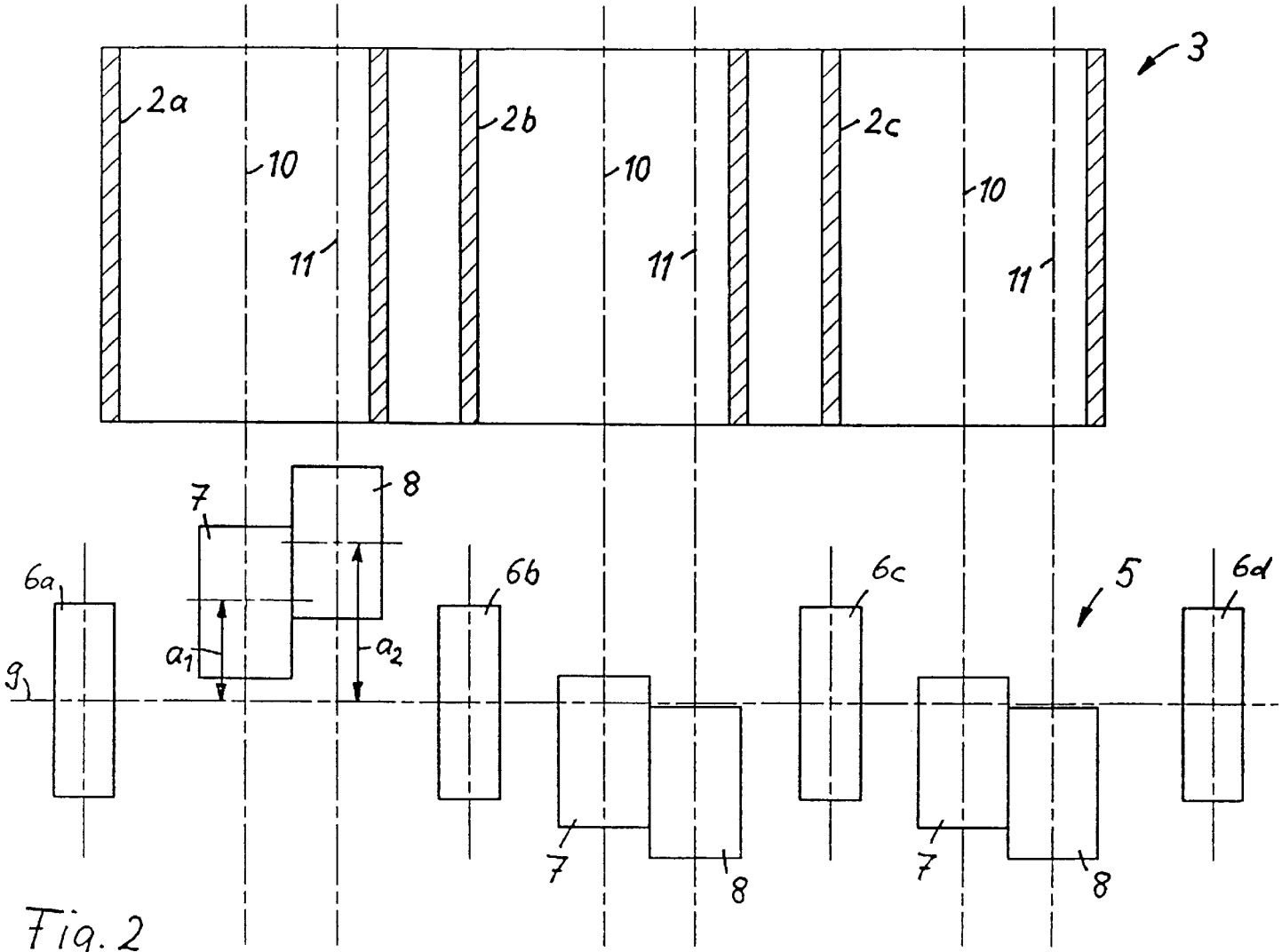
FIG. 2 shows a section along line II—II of FIG. 1.

The first cylinder bank 2 with cylinders 2*a*, 2*b* and 2*c* is shown in cross-section in FIG. 2. Disposed beneath the cylinders is the crankshaft 5, which is rotatably supported in main bearings 6*a*, 6*b*, 6*c* and 6*d* fixed to the engine housing and is driven by the reciprocating pistons in the cylinders. Between the main bearings 6*a*, 6*b*, 6*c* and 6*d* there is a total of three crankshaft sections, one between each two adjacent main bearings, corresponding to the number of cylinders in a cylinder bank. In each crankshaft section there are crank pins 7 and 8, which are integrally formed with the crankshaft 5 and have a radial offset $a_1$ or $a_2$ in relation to the crankshaft longitudinal axis 9. Connecting rods 13, 12 of the pistons 20, 19 of cylinders 3*a* and 2*a*, which are assigned to different cylinder banks and are disposed directly adjacent each other, act on the crank pins 7 and 8. The crank pins 7 and 8, viewed in the longitudinal direction of the crankshaft longitudinal axis 9, are shown in a position essentially aligned with the cylinder axes 10 and 11 of the cylinders 3*a* and 2*a* respectively.

Two crank pins 7 and 8, which are acted upon by pistons of adjacent cylinders of the first and second cylinder bank, are situated between each two adjacent main bearings.

The crank pins 7 and 8 of to the crankshaft 5 are disposed at different radial distance $a_1$ and $a_2$ from the crankshaft longitudinal axis 9. This makes it possible, when using the one-sided variable compression device described in FIG. 3, to create identical lever ratios for adjacent cylinders of different cylinder banks.

Figure 3:
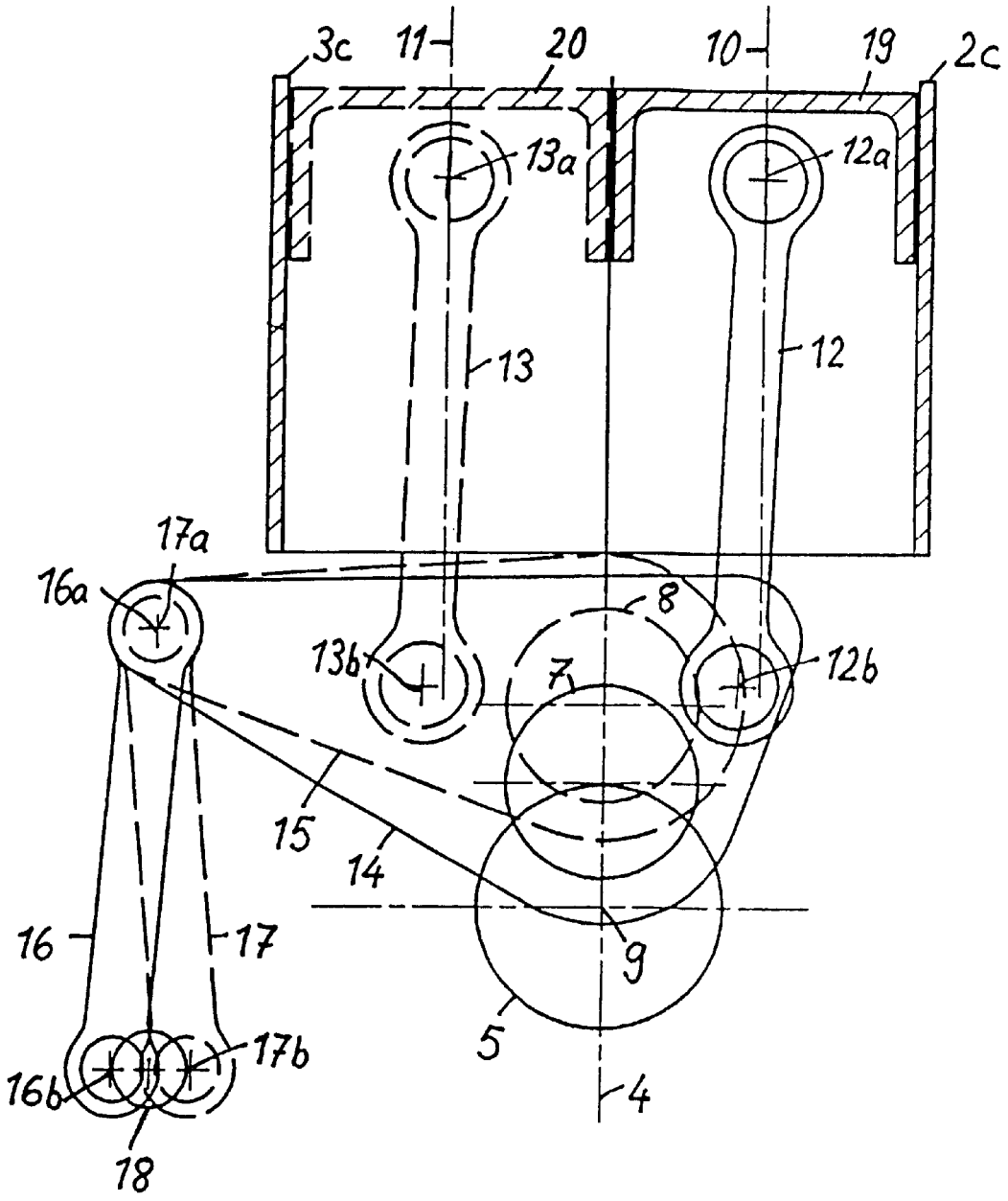
FIG. 3 shows a section along line III—III of FIG. 1.

FIG. 3 shows a section through adjacent cylinders 2*c* and 3*c* of the first and the second cylinder bank. It shows the mechanism for the adjustment of the compression ratio, the mechanism assigned to the cylinder 2*c* being drawn in solid lines and the mechanism assigned to the cylinder 3*a* in broken lines. The pistons 19 and 20 in the cylinders 2*c* and 3*c* respectively are connected by connecting rods 12 and 13 to cross levers 14 and 15, which are rotatably supported by the crank pins 7 and 8 of the crankshaft 5. The connecting rods 12 and 13 are articulated both at the end of the pistons 19 and 20 and at the ends of the cross levers 14 and 15 by way of joints 12*a*, 12*b* and 13*a*, 13*b* respectively. The joints 12*b* and 13*b* of the connecting rods 12 and 13 at the cross levers 14 and 15, respectively, are disposed at a distance from the respective crank pins 7 and 8. The crankshaft 5 is situated symmetrically in relation to the parting plane 4 between the two cylinder banks 2 and 3 of the internal combustion engine; the crankshaft longitudinal axis 9 lies in the parting plane 4. The connecting rods 12 and 13 extend approximately along the cylinder longitudinal axes 10 and 11 and, in operation of the internal combustion engine, in relation to the cylinder longitudinal axes are displaced by an angle in relation to the cylinder longitudinal axis, which is small enough to ensure that the connecting rods 12 and 13 do not touch the inside walls of the cylinders. The connecting rods 12 and 13 are disposed at opposite side of the parting plane 4 or the crankshaft longitudinal axis 9.

As shown in FIG. 3, both cross levers 14 and 15 extend to the same side of the internal combustion engine and are connected at their free ends by way of joints 16*a* and 17*a*, to control levers 16 and 17, which at their ends remote from the cross levers are pivotally connected by eccentric support joints 16*b* and 17*b* to a support shaft 18 and, in their movement, are positively guided thereby. The support shaft 18 extends parallel to the crankshaft 5. By joints 16*a* and 17*a* control levers 16 and 17 are connected to the cross levers 14 and 15. When the support shaft 18 rotates through an angle, which can assume a value between 0° and 360°, the control levers 16 and 17 adjust the connecting rods 12 and 13 and also the cross levers 14 and 15, whereupon the dead center positions of the pistons 19 and 20 are adjusted upwards or downwards within their cylinders, regardless of the piston movement attributable to the combustion processes in the combustion chambers above the pistons. In this way, the compression ratio in the combustion chambers in the cylinders can be changed by an actuation of the support shaft 18. For example, with a partial clockwise rotation of the support shaft 18, the control lever 16 is shifted upwards, so that the cross lever 14, which is pivotally connected to the control lever 16 is raised at the joint 16*a*, and the cross lever 14 is rotated clockwise about the crank pin 7 on the crankshaft 5, which in turn leads to a lowering of the joint 12*b* of the connecting rod 12 at the cross lever 14 and hence to a downwards adjustment of the piston 19. The combustion chamber above the piston 19 is thereby enlarged and the compression ratio reduced. At the same time the control lever 17 is moved downwards, with the result that the assigned cross lever 15 is pivoted counterclockwise about the crank pin 8, and the point of articulation 13*b*, which in relation to the joint 12*b* of the opposing connecting rod 12 lies on the opposite side of the parting plane 4, is displaced downwards and the piston 20 is therefore also moved downwards by the connecting rod 13. This also leads to an enlargement of the combustion chamber above the piston 20 and to a reduction of the compression ratio.

A corresponding design of the lever ratios ensures that, on actuation of the support shaft 18, the combustion chambers of all cylinders of both cylinder banks are enlarged or reduced in the same way and the compression ratio in all combustion chambers is uniformly adjusted.

What is claimed is:

1. A reciprocating piston internal combustion engine (1) having first and second cylinder banks (2, 3) each including at least two cylinders (2*a,* 2*b,* 2*c,* 3*a,* 3*b,* 3*c*) and being arranged adjacent each other in such a way, that the axes of the cylinders (2*a,* 2*b,* 2*c* and 3*a,* 3*b,* 3*c*) in the first and second banks (2, 3) extend essentially parallel, a piston (19, 20) movably disposed in each of said cylinders (2*c,* 3*c*), a crankshaft (5) rotatably supported so as to extend along said banks (2, 3) of cylinders between the longitudinal axes (10, 11) of the cylinders in the first and second cylinder banks (2, 3) and including for each cylinder a crank pin (7, 8), a cross-lever (14, 15) rotatably supported on each crank pin (7, 8) and extending therefrom in a direction essentially normal to the cylinder axes (10, 11) and the axis (9) of the crank shaft (5), a piston rod (12, 13) pivotally connected at one end to a piston (19, 20) and rotatably supported at the opposite end on a respective cross-lever (14, 15), and, for each cross-lever (14, 15) a control arm (16, 17) connected with one end to a free end of one of said cross-levers (14, 15) for acting on said cross-levers (14, 15) to adjust the compression ratio in the cylinders of said engine (1).

2. A reciprocating piston internal combustion engine according to claim 1, wherein the connecting rods (12, 13) of the pistons (19, 20) of adjacent cylinders of the first and second cylinder bank (2, 3) on opposite sides of the longitudinal axis (9) of the crankshaft (5) are each coupled to a cross-lever (14, 15) and each cross-lever (14, 15) is connected to one end of a control arm (16, 17), whose other end is adjustably supported on said engine (1).

3. A reciprocating piston internal combustion engine according to claim 1, wherein the cylinders (2*a,* 2*b,* 2*c*) of the first cylinder bank (2) are offset in relation to the cylinders (3*a,* 3*b,* 3*c*) of the second cylinder bank (3) in the direction of the crankshaft longitudinal axis (9).

4. A reciprocating piston internal combustion engine according to claim 1, wherein the cross-levers (14, 15) of adjacent cylinders of the first and second cylinder banks (2, 3) are disposed within a common crankshaft section between two adjacent main bearings (6*a,* 6*b,* 6*c,* 6*d*), by which the crankshaft (5) is supported.

5. A reciprocating piston internal combustion engine according to claim 4, wherein said common crankshaft section includes two crank pins (7, 8), of the crankshaft (5).

6. A reciprocating piston internal combustion engine according to claim 5, wherein an intermediate web is disposed between the two crank pins (7, 8).

7. A reciprocating piston internal combustion engine according to claim 5, wherein the two crank pins (7, 8) are arranged on the crankshaft (5) at one of the same and a different radial distance ($a_1$, $a_2$) from the crankshaft longitudinal axis (9), the two crank pins (7, 8) acting on the cross levers (14, 15) of adjacent cylinders of the first and second cylinder banks (2, 3).

8. A reciprocating piston internal combustion engine according to claim 1, wherein the control levers (16, 17), which are assigned to cross levers (14, 15) of adjacent cylinders of the first and second cylinder banks (2, 3), are disposed at the same side of the internal combustion engine (1).

9. A reciprocating piston internal combustion engine according to claim 1, wherein the control arms (16, 17) are disposed at opposite sides of the internal combustion engine (1).

10. A reciprocating piston internal combustion engine according to claim 1, wherein common actuating member is provided for the control arms (16, 17), which are assigned to cross-levers (14, 15) of adjacent cylinders of the first and second cylinder bank (2, 3).

11. A reciprocating piston internal combustion engine according to claim 10, wherein at least one support shaft (18) is provided as actuating member.

* * * * *